United States Patent [19]

Carr

[11] 4,449,771

[45] May 22, 1984

[54] BUS BAR

[76] Inventor: David W. Carr, 7325 Muslo La., Carlsbad, Calif. 92008

[21] Appl. No.: 102,230

[22] Filed: Dec. 10, 1979

[51] Int. Cl.[3] ..... H01R 13/02

[52] U.S. Cl. ..... 339/19

[58] Field of Search ..... 339/18 C, 18 P, 19, 339/198 N, 222, 242, 20, 21, 22 R, 59, 61

[56] References Cited

U.S. PATENT DOCUMENTS

| | | | |
|---|---|---|---|
| 2,108,031 | 2/1938 | Acuff | 339/59 M |
| 2,254,280 | 9/1941 | Gottheimer | 339/61 C |
| 2,931,006 | 3/1960 | Klumpp, Jr. | 339/59 M |
| 3,771,102 | 11/1973 | Murray et al. | 339/19 |
| 3,951,497 | 4/1976 | Balzano et al. | 339/242 |
| 4,029,377 | 6/1977 | Guglielmi | 339/19 |

FOREIGN PATENT DOCUMENTS

| | | | |
|---|---|---|---|
| 1554310 | 12/1968 | France | 339/22 R |

*Primary Examiner*—Joseph H. McGlynn
*Attorney, Agent, or Firm*—Duane C. Bowen

[57] ABSTRACT

A miniaturized plastic bus bar connecting a series of spaced terminal pins arranged in a row. The bar has U-shaped cross-section or the like with parallel legs and a connecting base web; and the web has openings formed by slots removing the bar base in the area of each pin. When one metal bar is used, the opposite leg can have a longitudinally extending boss to contact the pins and the opposite leg can be divided between each opening to localize the resilient force of the plastic material in gripping each pin. One or two metal conductive strips are set in one or both legs in position to bear on the pins. Insulation of metal strips at all or part of the pin locations and selective removal of insulation permits various circuit connections to the pins. Surfaces of boss and strips that the pins initially contact upon entry into said openings are disposed at camming angles for ease of bus bar installation.

2 Claims, 7 Drawing Figures

BUS BAR

BRIEF SUMMARY OF THE INVENTION

Background and Objectives

Figure 1:
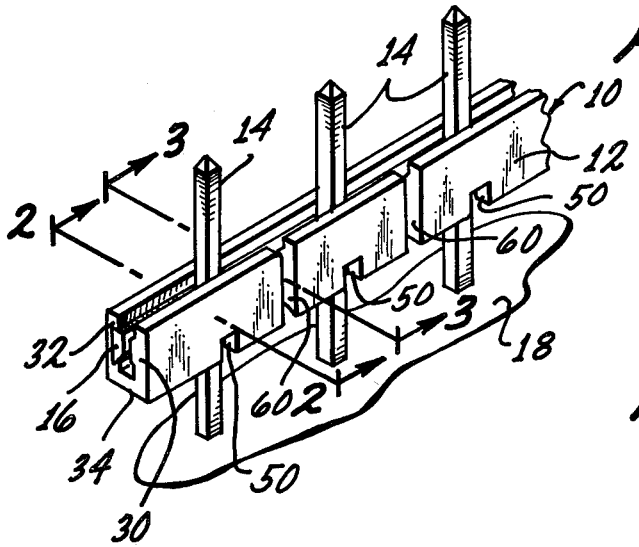

My invention relates generally to a bus bar and more specifically to a miniaturized bus bar adapted for various circuit connections to terminal pins.

I came to realize that a miniaturized bus bar was desirable that operated differently from those prior devices of which I was aware.

Through a preliminary examination search and otherwise I became aware of the following U.S. Pat. Nos.: 3,488,620; 4,150,864; 4,084,872; 3,582,864; 3,551,875; 4,029,377.

These prior patents do not appear to have the functional structural combinations claimed herein.

Some of the features and objectives I was after and which I achieved in designing bus bar 10 include:

(a) Use of an extruded plastic bus bar body 12 for insulation, resiliency and other properties and for economy of fabrication with suitable tolerances.

(b) Wide adaptability for various circuit connections to terminal pins 14 engaged by bus bar 10.

(c) Ability to use higher conductivity conductor 16 because conductor is not also used for spring properties. Most other bus bars I have encountered use spring metal contacts that require specific alloys of copper to achieve the desired spring characteristics, such as berillium copper which is only 22% as conductive as pure copper. In my bus bar 10 the spring characteristics is provided by the plastic of the bus bar body 12 so that I can use material for conductor 16 of pure copper or substantially equivalent in conductivity to pure copper.

(d) Less exposed conductive (metal) material 16 to minimize chance of shorting to adjacent wires, components, etc.

(e) Achieving two circuits with one bus bar 10 when desired.

(f) Ease of installation of bar 10 on pins 14.

(g) Avoidance of breakage of brittle metal spring parts during manufacture, in transit, during installation or reinstallation, etc.

(h) Lower cost due to avoidance of the complex metal forming and tempering that were required with the spring metal of other prior designs.

(i) Economy of manufacture, reliability of product, and ease of use.

My invention will be best understood, together with additional objectives and advantages thereof, from the following description, read with reference to the drawings, in which:

FIGURE DESCRIPTIONS

FIG. 1 is a perspective view of portions of a bus bar 10 engaged with a series of terminal pins 14 of a terminal board 18 or other electrical/electronic assembly or apparatus.

Figure 2:
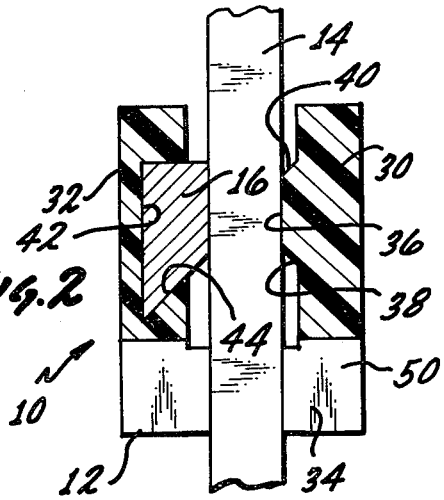

FIG. 2 is a sectional view taken on line 2—2 of FIG. 1.

Figure 3:
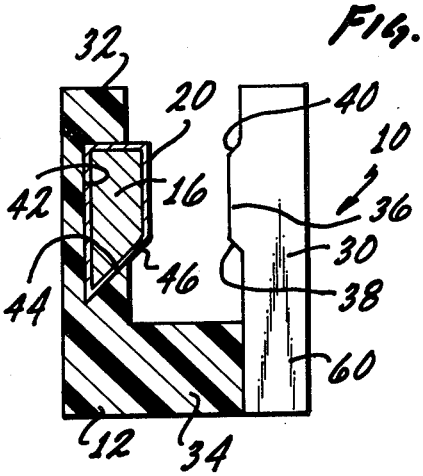

FIG. 3 is a sectional view taken on line 3—3 of FIG. 1 but showing a metal strip conductor 10 which has a non-conductive surface coating 20, whereas the conductor shown in FIG. 2 is bare.

Figure 4:
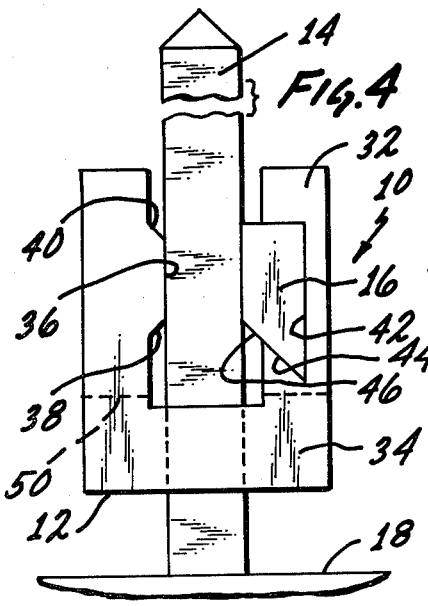

FIGS. 4, 5, 6 and 7 are end views such as would be seen from the right hand end of bus bar 10 in FIG. 1, but showing various bus bar configurations for different applications or demonstrating different alternatives. In FIG. 4, portions of a terminal pin 14 and of the planar object 18 from which pins 14 extend are also shown.

GENERAL DESCRIPTION

It will be understood that various electrical/electronic assemblies and apparatus, such as terminal boards, have a surface 18 from which a series of terminal pins 14 extend and that it is desirable to be able to connect pins 14 in one or more circuits by the use of a bus bar 10. I am particularly concerned with miniaturized bus bars. "Miniaturized" is defined as bus bars having a height no greater than ¼ inch. In fact the maximum height is more likely to be a maximum of about ⅛ inch, so it will be understood I am dealing with relatively small bus bars. Whereas such miniaturized bus bars have some of the same requirements as large bus bars, on the other hand some of the requirements, specifications, problems, desirable features, etc., will be peculiar to miniaturized bars.

I will first describe the cross-sectional structure shown in FIG. 2 and the various applications of the structural details to FIGS. 3–7 will be understood. The cross-section of the elongated plastic body 12 can be said to be U-shaped with parallel legs 30, 32 and a connecting web 34 between the legs at the base of the U-shape.

Leg 30 has a boss 36 that forms the portion of leg 30 gripping terminal pin 14. The surface 38 of boss 36 that pin 14 first strikes in bus bar installation is disposed at an acute angle to the direction of entry of pin 14 and to the axis of pin 14 to ease pin entry and also to minimize abrasion. In fact, the opposite face 40 of boss 36 can likewise be disposed at an acute angle to the direction of withdrawal of pin 14 for ease of action and to minimize abrasion when bus bar 10 is being withdrawn from terminal pins 14.

Leg 32 has a longitudinal groove 42 therein to receive metal strip 16. Groove 42 can be the same size as strip 16 when non-conductive covering 20 on strip 16 is absent as in FIGS. 2, 4 and 6 or is only on the strip surface outside of groove 42 as in FIG. 5 and on the right hand side in FIG. 7. Groove 42 must be large enough to accommodate covering 20 as well as strip 16 (the groove 42 can be larger or the strip 16 can be smaller) when the non-conductive coating 20 covers all sides of strip 16 as in FIG. 3 and on the left hand side in FIG. 7. It will be understood that I have elected to show uncoated, partially coated or fully coated strips arbitrarily between the various figures, as I merely wanted to indicate the various possibilities.

Figure 7:
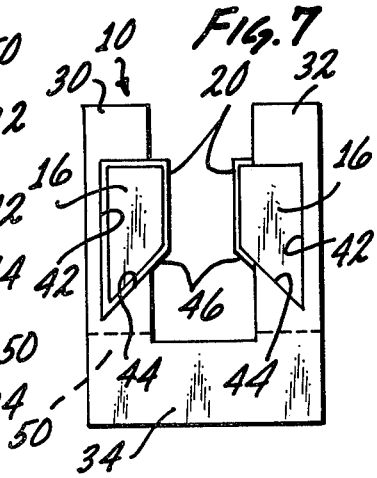

In the case of FIG. 7 I have shown grooves 42 in both legs 30 and 32 and no boss 36. It will be recognized that with two metal conductors 16, more complicated circuitry can be applied to terminal pins 14.

When it is desirable in original manufacture to apply an insulative covering 20 to metal conductor strips 16 at the locations of terminal pins 16, the choices include either completely covering strips 16, as in FIG. 3 or the left hand side in FIG. 7, or only covering the portions of strips 16 exposed outside grooves 42. If the insulative covering 20 were to have the form of a coating to be applied to strips 16 by dipping, complete covering of strips 16 might be the most practical approach, whereas if the insulative coating 20 were to have the form of a tape to be applied to the surfaces of strips 16, then covering of only the exposed portions of strips 16 after they are engaged in grooves 42 might be the most practical approach.

An insulative covering 20 could be applied from end to end of each strip 16 or it could be applied only at the locations of potential engagements with terminal pins 14, or only at some of such locations. One approach in original manufacture is to insulate all locations where strips 16 might contact pins 14 and then in original manufacture or later to remove non-conductive covering 20 selectively wherever it is desired to obtain electrical connection between a particular strip 16 and a particular pin 14.

Strips 16 can be bonded in grooves 42. As a substitute for bonding or as a supplemental means of securing strips 16 in grooves 42, grooves 42 and strips 16 can be formed to mate against dislodgement. In the configurations shown in the drawings, groove 42 is undercut as to its side 44 toward terminal pin support 18. This means each groove 42 flares in a direction away from the opposite leg 30 or 32 and away from the mouth of the groove 42 and embedded strips 16 are configured to match the flaring of the grooves to fit the same whereby the strips are at least partly retained in place by the mating shapes of grooves and strips.

An additional feature of the strip 16 and grooves 42 is to note that groove walls 44 are undercut at an acute angle to the associated leg 30 or 32 and each strip 16 has a contour matching its associated groove so that each strip 16 has a side 46 facing pins 14 as they enter bus bar 10 which is at a matching acute angle to groove wall 44 whereby pins 14 will strike side 46 of each strip 16 at a camming angle for ease of passage by the metal strip 16 and to minimize abrasion with pins 14. The exposed portions of strip sidewalls 46 thus are comparable to camming surfaces 38 of bosses 36 concerning ease of bus bar installation and in reducing abrasion or damage to pins 14 and strips 16 during bus bar installations.

Connecting webs 34 have spaced openings therealong mating with the terminal pins 14 that extend therethrough. For ease of manufacturing, I prefer to form the openings by slots 50 removing the base of the U-shaped cross-section including connecting web 34 at the location of each pin 14. In the case of the inverted U-shaped cross-section in FIG. 5, of course it is the connecting web 34 at the top of the form that has slots 50 and in the case of the box-shape of FIG. 6, slots 34 appear at both top and bottom.

The plastic material forming plastic body 12 is resilient whereby strips 16 and bosses 36 are pressed against pins 14 (presuming the distance therebetween is originally less than the thicknesses of the pins) to insure that portions of the strips 11 exposed to pins 14 (because they never had a covering 20 or such covering was removed) will maintain electrical conduction therewith and so that the pins 14 will be gripped by the bus bar 10 for retention thereon.

In the case of a bus bar 10 with only one metal strip 16, I prefer that the leg 30 opposite to the conductor strip be divided by slits or slots 60 between each slot 50, thereby localizing the resilient force of the plastic material on leg 30 bearing on pins 14. Because of irregularities or tolerances in manufacturing, there may be excessive variances in dimensions of distances between the opposed surfaces of bosses 36 and strips 16 and in dimensions of pins thicknesses. It will be understood that the use of slots 60 means that dimensional problems are more localized than would be the case if such slots 60 were absent. Note the problem if in locations of terminal pins 14 side-by-side, if coating 20 were removed from the strip 16 abutting one pin and not the other. Without such slot 16 between the pins, the extra thickness of the insulation on the strip at the location of one pin 14 would tend to interfere with contact of the bared strip at the location of the next pin 14.

Figure 5:
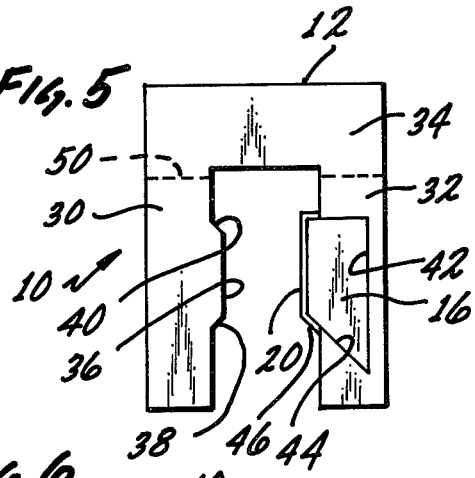
Figure 6:
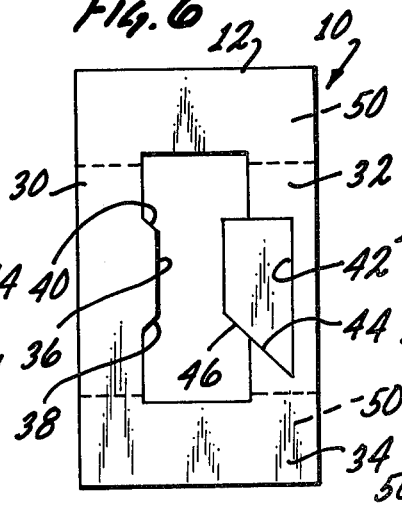

FIGS. 4 and 5 show similar configurations in the FIG. 4 can be said to have a U-shaped cross-section which is upright with connecting web 34 on the bottom, whereas FIG. 5 can be said to have a U-shaped cross-section which is inverted with connecting web 34 at the top. FIG. 6 could be said to be like the combination of FIGS. 4 and 5 together, i.e., having parallel legs 30, 32 and having connecting webs 34 at both top and bottom (as well as having slots 50 forming openings at both top and bottom). The FIG. 6 structure also could be described as having a box-shaped cross-section. The purpose of FIG. 7 is to demonstrate a configuration with strips 16 embedded in both legs 30 and 32. As stated before, the variations shown in the drawings also show bare conductors 16, conductors 16 having coverings 20 only on exposed parts outside of groove 42, and conductors 16 completely covered or coated.

I have thus provided for the following options:

1. One-sided bus electrically connecting all terminals.
2. One-sided bus insulated in specific areas to electrically connect only specific pins in a row.
3. Two-sided bus with no insulation to provide double conductivity to all pins in a row.
4. Two-sided bus with insulation at the same locations on both sides to provide double conductivity only to specific pins in a row.
5. Two-sided bus with insulation on at least one side and possibly both sides of each pin location to provide two circuits in one row, each pin being on one circuit or neither circuit.

Plastic body 12 preferably is formed from an extruded resin. It would be possible to injection mold from a thermoplastic or thermosetting plastic. It will be understood there are a number of plastics of appropriate electrical or mechanical properties. The space between boss 36 and conductor 16 would be only slightly smaller than the thicknesses of pins 14 if a more rigid but resilient plastic were used, which I prefer. The space could be less down to zero if a more flexible plastic were used. Purposes to be achieved are providing pressure on the pins 14 for good conductor contact and providing positive retention of pins 14 by bus bar 10.

Conductor 16 could be formed of copper alloy 110. Conductor 16 could be formed from a wire by rolling processes on such wire to shape it as above described. Platings can be used in accordance with considerations in other electrical contacts, such as reducing oxidation. An example would be a nickel plating of a minimum thickness of 0.00010 inches and a second plating of gold of a minimum thickness of 0.000030 inches. Other alloys of copper or other conductive materials could be substituted and strips 16 could be formed by milling or grinding processes.

Insulation 20 could be an adhesive tape wrapped completely around metal strips 16. Other possibilities, completely around strips 16 or only on their faces, would be tubing shrunk onto strips 16 or a coating applied as a liquid.

Slots 50 are preferably saw cut. Either as slots or as otherwise shaped openings, such openings could be drilled or hot punched. Slots or slits 60 are preferably saw cut but could be hot punched or scribed.

Having thus described my invention, I claim:

1. In combination with a series of spaced terminal pins arranged in a row, a bus bar, comprising:

(a) an elongated bus bar body formed of non-conductive plastic material, (b) said body being of U-shaped cross-section defined by parallel legs and a connecting web between said legs, (c) said web having spaced openings therealong mating with said terminal pins which extend therethrough, each opening being formed in said body by a slot removing the base of said U-shaped cross-section including said connecting web, (d) each of said legs having on its inner surface facing the other leg a conductive metal strip extending parallel to the longitudinal axis of said body and positioned to bear on said pins, each of said legs having a groove therein and said strips being partially embedded in said grooves, the side of each groove toward said openings being undercut at an acute angle to the associated leg and each strip having a contour matching the associated groove so that each strip has a side toward said openings which is at an acute angle to the direction of entry of said pins through said openings whereby said pins will strike said side of each strip at a camming angle for ease of passage by each strip, (e) said strips having non-conductive surface coverings at least at some of the locations of said openings and said pins, and said surface coverings being partly removed at locations corresponding at least to some of said pins for electrical conduction with said strips, and (f) said plastic material being resilient and said strips thereby being resiliently pressed against said pins to insure that portions of said strips exposed to said pins will maintain electrical conduction therewith and so that said pins will be gripped for bus bar body retention thereon.

2. In combination with a series of spaced terminal pins arranged in a row, a bus bar, comprising:

(a) an elongated bus bar body formed of non-conductive plastic material, (b) said body being of U-shaped cross-section defined by parallel legs and a connecting web between said legs, (c) said web having spaced openings therealong mating with said terminal pins which extend therethrough, (d) one of said legs having on its inner surface facing the other leg a conductive metal strip extending parallel to the longitudinal axis of said body and positioned to bear on said pins, said one leg having a groove therein and said strip being partially embedded in said groove, the side of said groove toward said openings being undercut at an acute angle to said one leg and said strip having a contour matching said groove so that said strip has a side toward said openings which is at an acute angle to the direction of entry of said pins through said openings whereby said pins will strike said side of said strip at a camming angle for ease of passage by said strip, (e) said other leg having a raised boss disposed oppositely to said strip and forming the portion of said other leg bearing on said pins and the wall of said boss towards said openings being at an acute angle for ease of passage by said boss, (f) said strip having non-conductive surface coverings at the locations of at least part of said openings and said pins, and said surface coverings being at least partly removed at locations corresponding at least to some of said pins for electrical conduction with said strip, and (g) said plastic material being resilient and said strip and said boss thereby being resiliently pressed against said pins to insure that portions of said strip exposed to said pins will maintain electrical conduction therewith and so that said pins will be gripped for bus bar retention thereon, said other leg being divided between each opening and pin thereby localizing the resilient force of said plastic material in said other leg bearing on each pin.

* * * * *